US010231516B2

(12) United States Patent
Wu

(10) Patent No.: US 10,231,516 B2
(45) Date of Patent: Mar. 19, 2019

(54) WOVEN CLOTH WITH SHOELACE LOOPS

(71) Applicant: Tsung-Jung Wu, Taichung (TW)

(72) Inventor: Tsung-Jung Wu, Taichung (TW)

( * ) Notice: Subject to any disclaimer, the term of this patent is extended or adjusted under 35 U.S.C. 154(b) by 0 days.

(21) Appl. No.: 15/644,336

(22) Filed: Jul. 7, 2017

(65) Prior Publication Data

US 2019/0008235 A1 Jan. 10, 2019

(51) Int. Cl.

| | |
|---|---|
| ***A43C 1/04*** | (2006.01) |
| ***D03D 1/00*** | (2006.01) |
| ***D03D 15/00*** | (2006.01) |
| ***D03D 15/08*** | (2006.01) |
| ***D03D 13/00*** | (2006.01) |
| ***A43B 7/08*** | (2006.01) |
| ***A43B 23/02*** | (2006.01) |

(52) U.S. Cl.

CPC ..... *A43C 1/04* (2013.01); *A43B 7/085* (2013.01); *A43B 23/0205* (2013.01); *D03D 1/00* (2013.01); *D03D 13/008* (2013.01); *D03D 15/0033* (2013.01); *D03D 15/0094* (2013.01); *D03D 15/08* (2013.01)

(58) Field of Classification Search

CPC . D03D 3/02; D03D 3/00; D03D 11/02; D03D 3/06; D03D 13/008; D03D 15/0033; D03D 15/0094; D03D 15/08; A43C 1/04; A43C 1/06; A43B 23/0245

See application file for complete search history.

(56) References Cited

U.S. PATENT DOCUMENTS

| | | | | |
|---|---|---|---|---|
| 3,001,579 | A * | 9/1961 | Van Doren | A47H 13/16 139/387 A |
| 3,497,971 | A * | 3/1970 | Hayashi | A43B 1/14 36/45 |
| 5,662,147 | A * | 9/1997 | Haiber | D03D 11/02 139/384 R |
| 7,287,553 | B2 * | 10/2007 | Wahhoud | D03C 7/06 139/101 |
| 9,924,761 | B2 * | 3/2018 | Huffa | A43B 1/04 |
| 2004/0185734 | A1 * | 9/2004 | Gray | B29C 70/22 442/312 |
| 2006/0059715 | A1 * | 3/2006 | Aveni | A43B 7/08 36/45 |
| 2011/0041359 | A1 * | 2/2011 | Dojan | A43B 23/025 36/47 |
| 2012/0291908 | A1 * | 11/2012 | Lama | D03D 27/00 139/400 |
| 2017/0145608 | A1 * | 5/2017 | Ko | D04B 21/10 |

* cited by examiner

*Primary Examiner* — Danny Worrell
(74) *Attorney, Agent, or Firm* — Muncy, Geissler, Olds & Lowe, P.C.

(57) ABSTRACT

Woven cloth with shoelace loops is formed by a plurality of longitudinal threads and a plurality of lateralwise threads. Each of the plurality of longitudinal thread is woven by a plurality of filaments. Each of the plurality of lateralwise thread is interwoven with and ties the plurality of longitudinal threads to form a plurality of knots. At least a part of the longitudinal threads are continuously and integrally connected to form a plurality of curved back lace loops each sized for a lace or a buckle to dispose therethrough.

9 Claims, 7 Drawing Sheets

WOVEN CLOTH WITH SHOELACE LOOPS

BACKGROUND OF THE INVENTION

Field of the Invention

The present invention relates to woven cloth with shoelace loops.

Description of the Prior Art

Recently, people are fastidious about the quality of life, and comfortableness of shoes such fitness, weight, ventilation and fashion design, for example, is purchased and improved.

Generally, a shoe includes a sole and an upper. The upper is connected to the sole and form a room for wearing of a foot thereinto. The upper is generally provided with eyelets disposed therethrough, and the eyelets are for a shoelace to dispose therethrough so as to adjust the room to fit the foot. However, the conventional eyelets are formed by directly penetrating the upper, which damages and degrades the structure of the upper so that the upper can be broken easily due to the tension of the shoelace. Besides, the conventional eyelets are an additional member additionally attached to the upper, thus being easy to detach from the upper.

The present invention is, therefore, arisen to obviate or at least mitigate the above mentioned disadvantages.

SUMMARY OF THE INVENTION

An object of the present invention is to provide woven cloth with shoelace loops which are made integrally therewith.

To achieve the above and other objects, woven cloth with shoelace loops is provided. The woven cloth with shoelace loops is formed by a plurality of longitudinal threads and a plurality of lateralwise threads. Each longitudinal thread is woven by a plurality of filaments. Each of the plurality of lateralwise thread is interwoven with and ties the plurality of longitudinal threads to form a plurality of knots. At least a part of the longitudinal threads are continuously and integrally connected to form a plurality of curved back lace loops each sized for a lace or a buckle to dispose therethrough.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
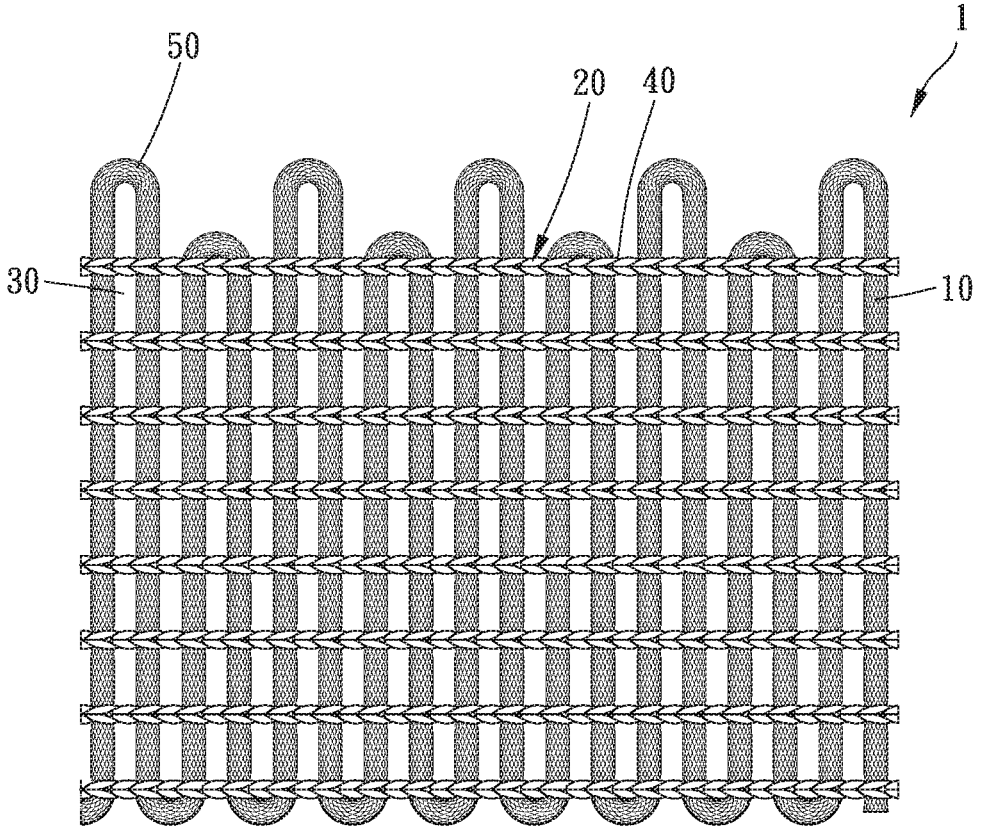
FIG. 1 is a plan view according to a first preferred embodiment of the present invention.
Figure 2:
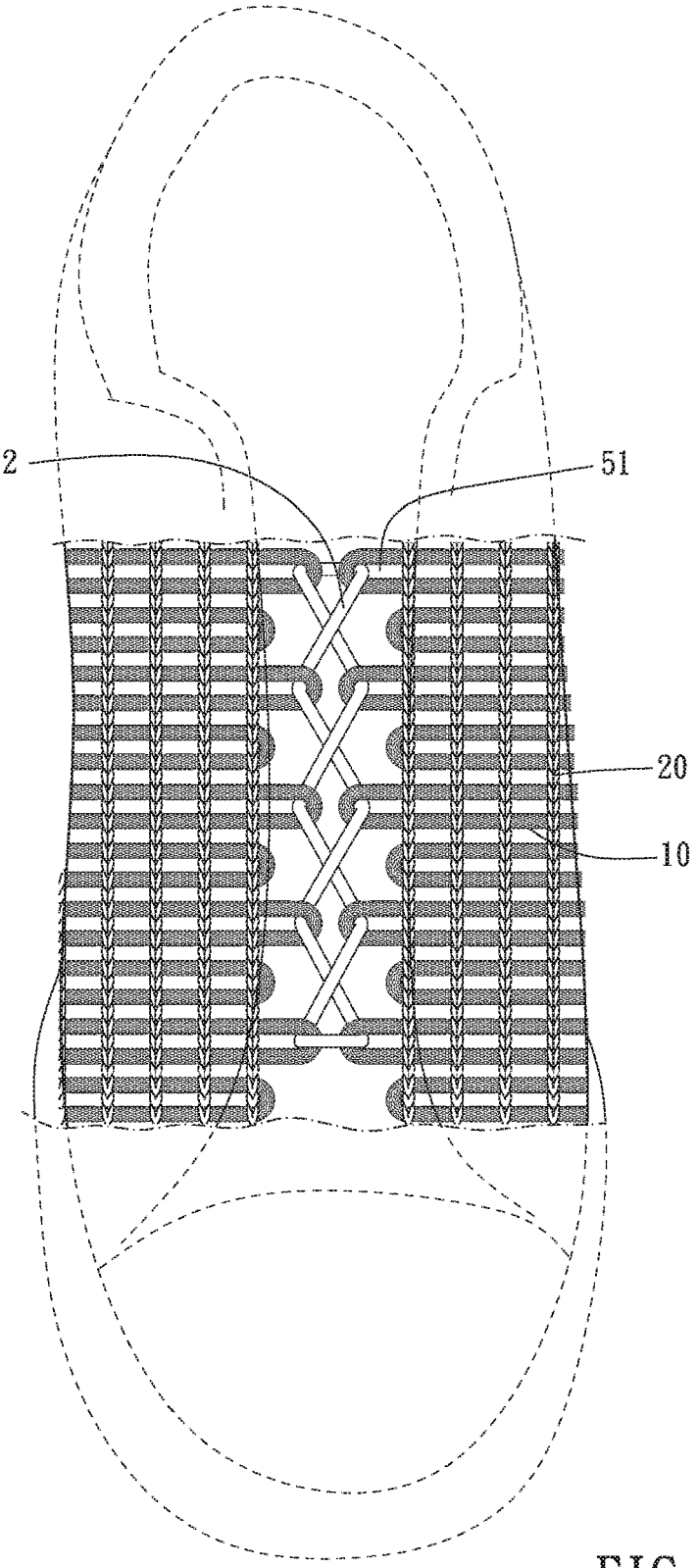
FIG. 2 is a top view of an application of a woven cloth with shoelace loops shown in FIG. 1.

FIGS. 1-2 show woven cloth with shoelace loops according to a first preferred embodiment of the present invention. The woven cloth with shoelace loops 1 is formed by a plurality of longitudinal threads (such as warp threads) 10 and a plurality of lateralwise threads (such as weft threads) 20, each of the plurality of longitudinal threads 10 is woven by a plurality of filaments, the plurality of longitudinal threads 10 are arranged in parallel and distanced from one another, the plurality of lateralwise threads 20 are distanced from one another, the plurality of longitudinal threads 10 and the plurality of lateralwise threads 20 are interwoven to form a plurality of meshes 30, each of the plurality of lateralwise threads 20 is interwoven with and ties the plurality of longitudinal threads 10 to form a plurality of knots 40, each of the plurality of knots 40 is disposed between adjacent two of the meshes 30, and at least a part of the plurality of longitudinal threads 10 is continuously and integrally connected to form a plurality of curved back lace loops 50 each sized for a lace 2, a buckle or the like, to dispose therethrough. Whereby, the woven cloth with shoelace loops 1 includes the plurality of curved back lace loops 50 which are made integrally therewith. As a result, the woven cloth with shoelace loops 1 is strong, uneasy to be worn out, ventilative, flexible and stretchable and light-weight. The woven cloth with shoelace loops 1 may be additionally attached to or integrally formed with an upper of a shoe.

Every adjacent two of the plurality of curved back lace loops 50 are arranged with at least one of the plurality of longitudinal threads 10 therebetween. In this embodiment, every adjacent two of the plurality of curved back lace loops 50 are arranged, therebetween, with two of the plurality of longitudinal threads 10 which are continuously curved back and integrally connected with each other, for the shoelace 2 to dispose therethrough easily.

Each of the plurality of longitudinal threads 10 is greater than each of the plurality of lateralwise threads 20 in outer diameter. Preferably, each of the plurality of longitudinal threads 10 has an outer diameter greater than 3 times an outer diameter of each of the plurality of lateralwise threads 20. Preferably, the outer diameter of each of the plurality of longitudinal threads 10 is between 0.10 cm to 0.30 cm, and the outer diameter of each of the plurality of lateralwise threads 20 is between 0.01 cm to 0.10 cm. Preferably, a single thread is zigzagged to form the plurality of longitudinal threads 10, thus providing good strong structure, being uneasy to break or disengage from the plurality of lateralwise threads 20. Additionally, each of the plurality of longitudinal threads 10 and each of the plurality of lateralwise threads 20 are orthogonally interwoven, thus providing good support.

Each of the plurality of longitudinal threads 10 is greater than each of the plurality of lateralwise threads 20 in extensibility. The plurality of longitudinal threads 10 with relatively high extensibility provide good flexibility and stretchability, while the plurality of lateralwise threads 20 with relatively low extensibility can hold the plurality of longitudinal threads 10 in position. In this embodiment, each of the plurality of longitudinal threads 10 includes 8 to 32 of the filaments, each of the plurality of longitudinal threads 10 has a denier of 100 to 500, and each of the plurality of lateralwise threads 20 has a denier of 200 to 800.

The plurality of longitudinal threads 10 may have various intervals so that the plurality of lateralwise threads 20 are arranged in different regions with different densities, which can provides a plurality of regions with various stretchabilities and extensibilities and various visual effects.

The plurality of longitudinal threads 10 and the plurality of lateralwise threads 20 may be different in color, to show various designs and visual effects.

Figure 3:
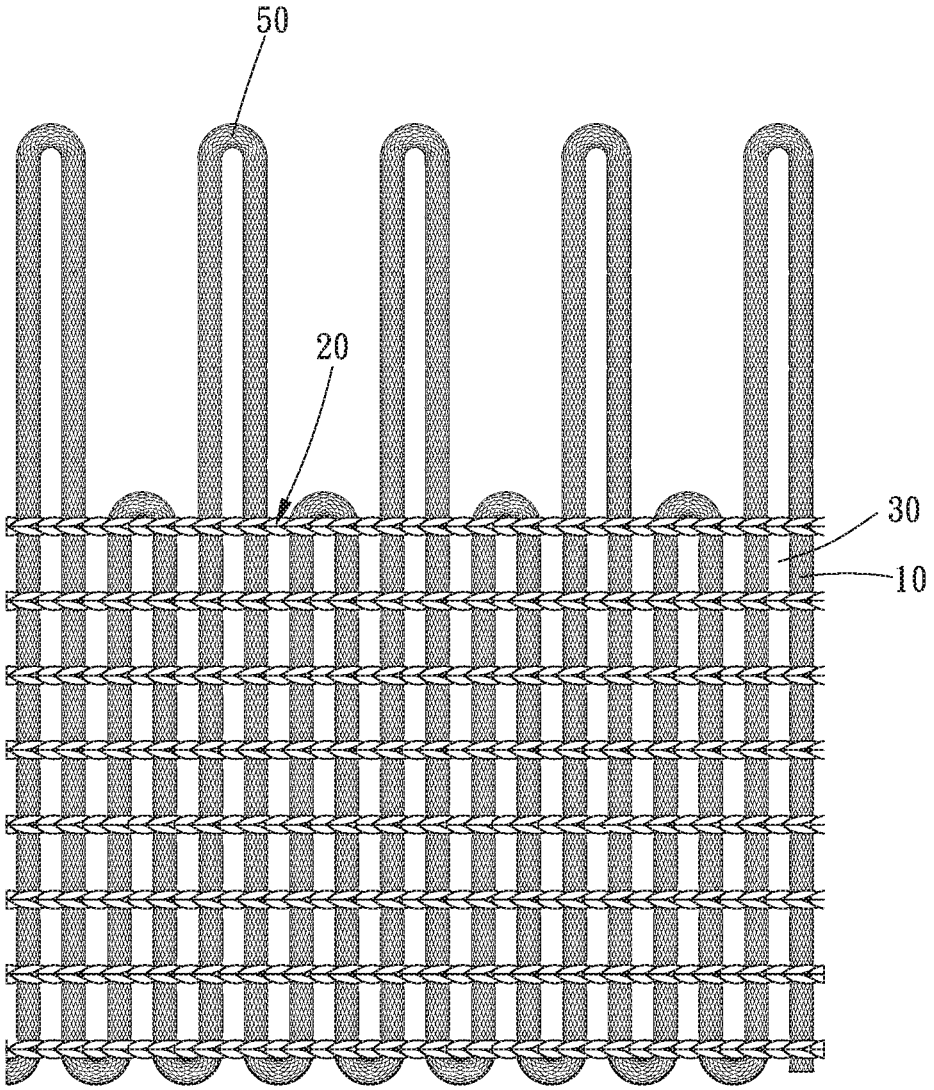
FIG. 3 is a plan view according to a second preferred embodiment of the present invention.
Figure 4:
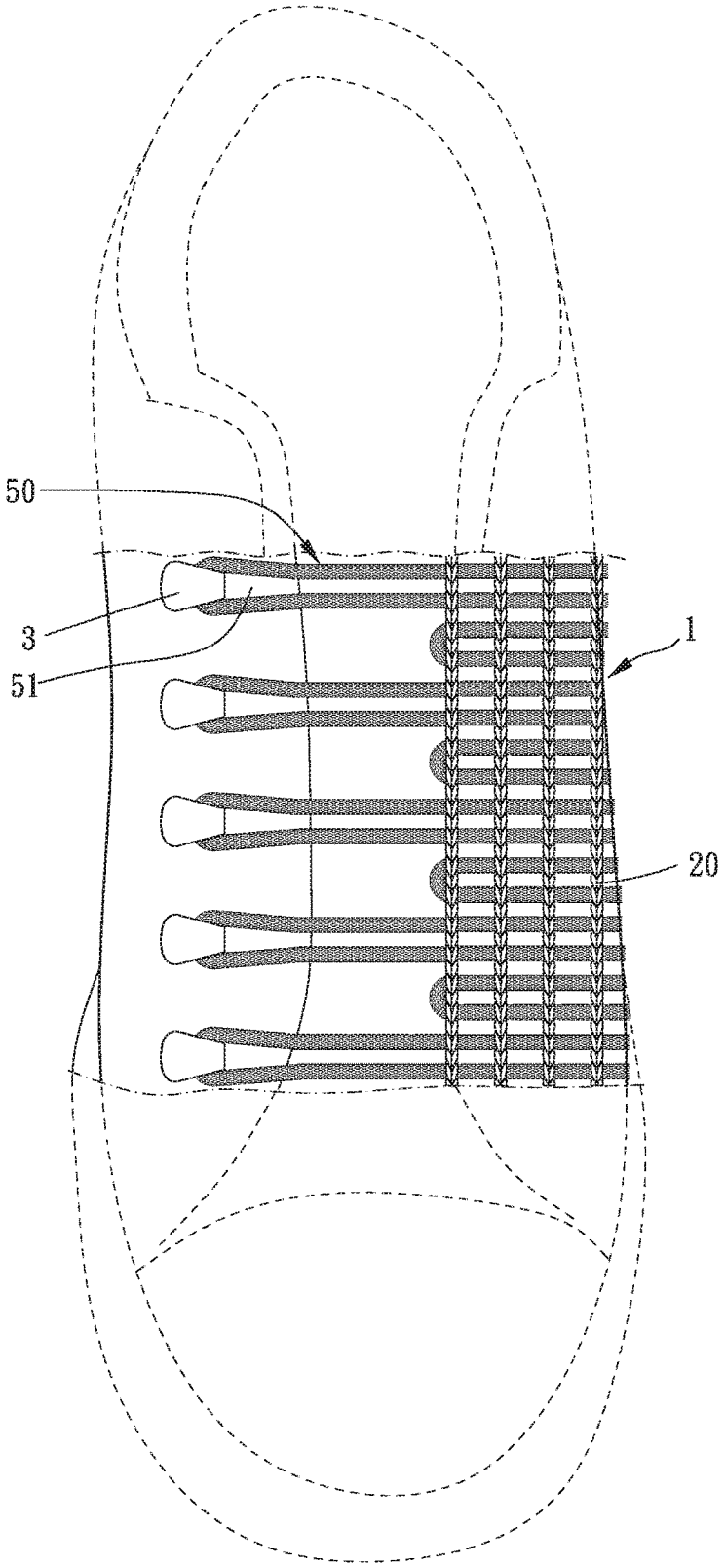
FIG. 4 is a top view of an application of a woven cloth with shoelace loops shown in FIG. 3.

FIGS. 3 and 4 show a second preferred embodiment according to the present invention. As compared with the first preferred embodiment, each of the plurality of curved back lace loops 50 has a buckle hole 51 larger than the meshes 30, for the shoelace 2 to dispose therethrough easily. The buckle hole 51 of each of the plurality of curved back lace loops 50 is larger than at least 1.5 times the meshes 30, to increase stretchability and extensibility of each of the plurality of curved back lace loops 50. As shown in FIG. 4, for example 4, each of the plurality of curved back lace loops 50 can stretch from one side of the shoe to hang on the buckle 3 on an opposite side of the shoe.

Figure 5:
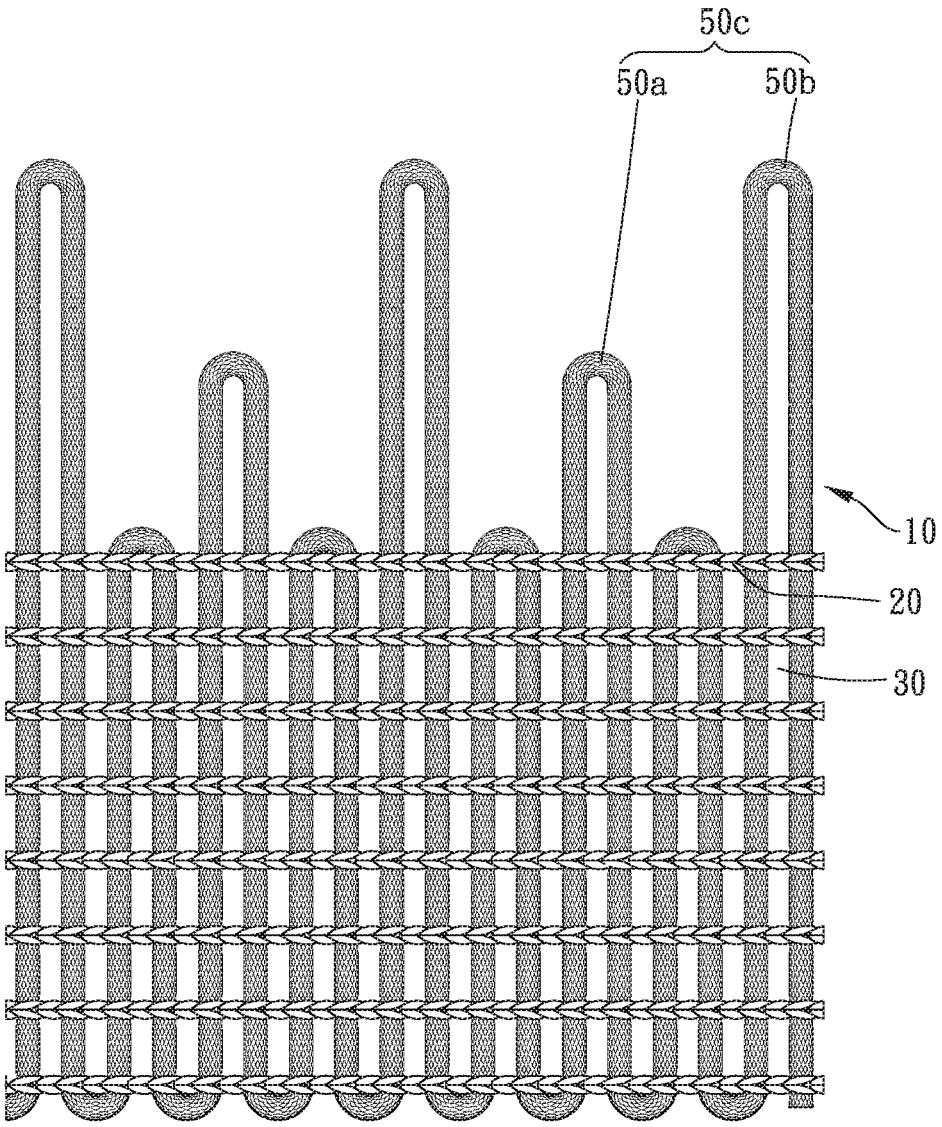
FIG. 5 is a plan view according to a third preferred embodiment of the present invention.
Figure 6:
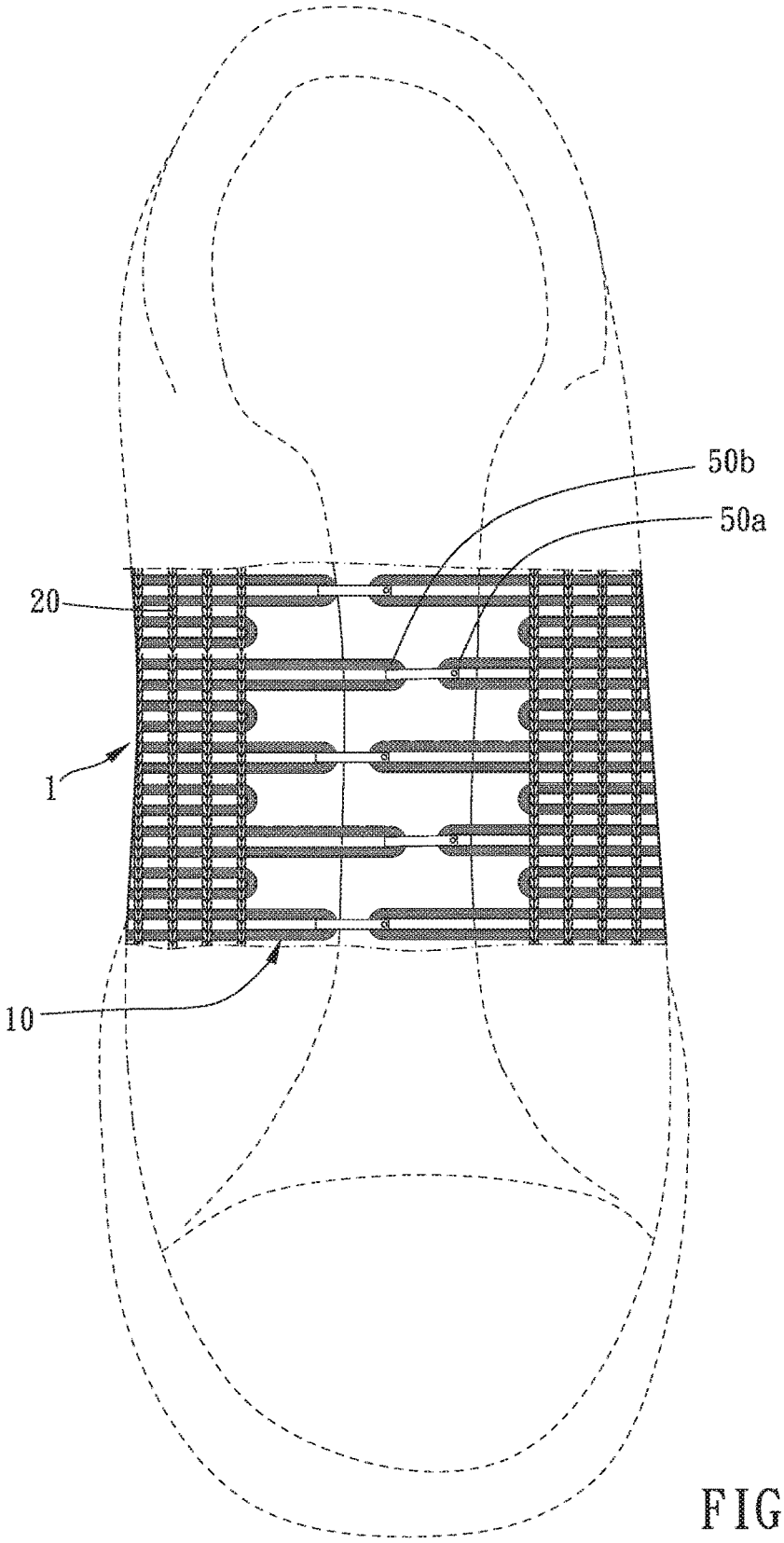
FIG. 6 is a top view of an application of a woven cloth with shoelace loops shown in FIG. 5.
Figure 7:
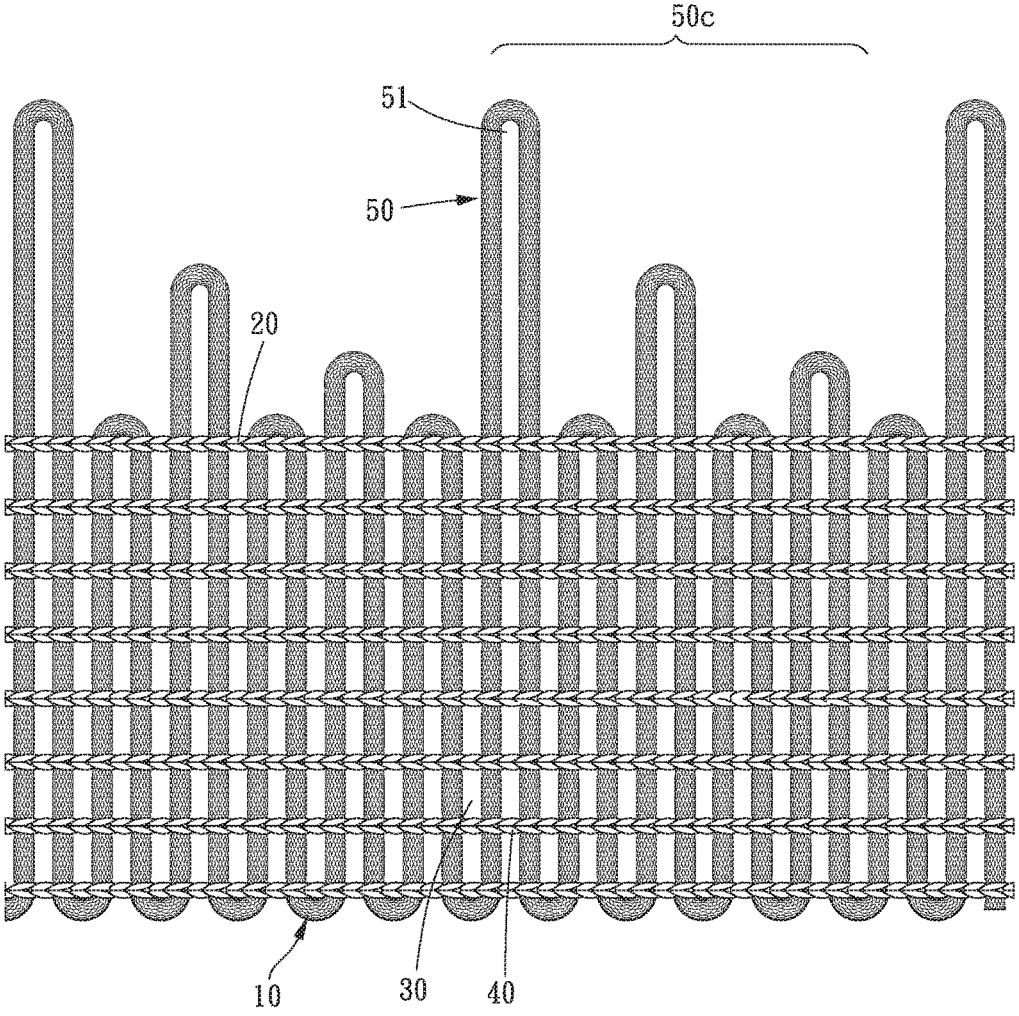
FIG. 7 is a plan view according to another type of the third preferred embodiment of the present invention.

FIGS. 5-7 show a third preferred embodiment according to the present invention. As compared with the first preferred embodiment, the plurality of curved back lace loops 50 include two different loop sizes, in which some of the plurality of curved back lace loops 50 are long and some of the plurality of curved back lace loops 50 are short, as the plurality of curved back lace loops 50*a*, 50*b* shown in FIG. 5. In other embodiment, the plurality of curved back lace loops 50 may have the same loop sizes. Preferably, the plurality of curved back lace loops 50 include at least one lace loop group 50*c*, and each lace loop group 50*c* includes at least two different loop sizes. For example, the lace loop group 50*c* includes a plurality of curved back lace loops 50*a* which are short and a plurality of curved back lace loops 50*b* which are long according to various requirements.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. Woven cloth with shoelace loops, formed by a plurality of longitudinal threads and a plurality of lateralwise threads, each of the plurality of longitudinal threads including a plurality of filaments, each of the plurality of lateralwise threads being interwoven with and ties the plurality of longitudinal threads to form a plurality of knots, at least a part of the plurality of longitudinal threads being continuously and integrally connected to form a plurality of curved back lace loops each sized for a lace or a buckle to dispose therethrough;

wherein the plurality of curved back lace loops include at least two different loop sizes.

2. The woven cloth with shoelace loops of claim 1, wherein every adjacent two of the plurality of curved back lace loops are arranged with at least one of the plurality of longitudinal threads therebetween.

3. The woven cloth with shoelace loops of claim 1, wherein the plurality of curved back lace loops include at least one lace loop group, and each of the at least one lace loop group includes at least two different loop sizes.

4. Woven cloth with shoelace loops, formed by a plurality of longitudinal threads and a plurality of lateralwise threads, each of the plurality of longitudinal threads including a plurality of filaments, each of the plurality of lateralwise threads being interwoven with and ties the plurality of longitudinal threads to form a plurality of knots, at least a part of the plurality of longitudinal threads being continuously and integrally connected to form a plurality of curved back lace loops each sized for a lace or a buckle to dispose therethrough;

wherein the plurality of longitudinal threads and the plurality of lateralwise threads are interwoven to form a plurality of meshes, and each of the plurality of curved back lace loops has a buckle hole larger than the mesh.

5. The woven cloth with shoelace loops of claim 4, wherein the buckle hole of each of the plurality of curved back lace loops is larger than 1.5 times the mesh.

6. Woven cloth with shoelace loops, formed by a plurality of longitudinal threads and a plurality of lateralwise threads, each of the plurality of longitudinal threads including a plurality of filaments, each of the plurality of lateralwise threads being interwoven with and ties the plurality of longitudinal threads to form a plurality of knots, at least a part of the plurality of longitudinal threads being continuously and integrally connected to form a plurality of curved back lace loops each sized for a lace or a buckle to dispose therethrough;

wherein each of the plurality of longitudinal threads is greater than each of the plurality of lateralwise threads in outer diameter.

7. The woven cloth with shoelace loops of claim 6, wherein each of the plurality of longitudinal threads has an outer diameter greater than 3 times an outer diameter of each of the plurality of plurality of lateralwise threads.

8. The woven with shoelace loops cloth of claim 1, wherein each of the plurality of longitudinal threads is greater than each of the plurality of lateralwise threads in extensibility.

9. The woven cloth with shoelace loops of claim 3, wherein every adjacent two of the plurality of curved back lace loops are arranged with at least one of the plurality of longitudinal threads therebetween; the plurality of longitudinal threads are arranged in parallel and distanced from one another; the plurality of lateralwise threads are distanced from one another; the plurality of longitudinal threads and the plurality of lateralwise threads are interwoven to form a plurality of meshes, and each of the plurality of curved back lace loops has a buckle hole larger than the mesh; the buckle hole of each of the plurality of curved back lace loops is larger than 1.5 times the mesh; each of the plurality of longitudinal threads is greater than each of the plurality of lateralwise threads in outer diameter; each of the plurality of longitudinal threads has an outer diameter greater than 3 times an outer diameter of each of the plurality of plurality of lateralwise threads; the outer diameter of each of the plurality of longitudinal threads is between 0.10 cm to 0.30 cm, and the outer diameter of each of the plurality of lateralwise threads is between 0.01 cm to 0.10 cm; each of the plurality of longitudinal threads is greater than each of the plurality of lateralwise threads in extensibility; each of the plurality of longitudinal threads includes 8 to 32 of the filaments, each of the plurality of longitudinal threads has a denier of 100 to 500, and each of the plurality of lateralwise threads has a denier of 200 to 800; a single thread is zigzagged to form the plurality of longitudinal threads; the plurality of longitudinal threads and the plurality of lateralwise threads are different in color; the plurality of longitudinal threads and the plurality of plurality of lateralwise threads are orthogonally interwoven; each of the plurality of knots is disposed between adjacent two of the plurality of meshes.

* * * * *